US007714713B2

(12) United States Patent
Yamada et al.

(10) Patent No.: US 7,714,713 B2
(45) Date of Patent: May 11, 2010

(54) RELAY APPARATUS

(75) Inventors: Tomomi Yamada, Nagoya (JP); Keiji Kato, Nagoya (JP)

(73) Assignee: Rinnai Corporation, Aichi-ken (JP)

( * ) Notice: Subject to any disclaimer, the term of this patent is extended or adjusted under 35 U.S.C. 154(b) by 331 days.

(21) Appl. No.: 11/754,602

(22) Filed: May 29, 2007

(65) Prior Publication Data

US 2007/0290872 A1 Dec. 20, 2007

(30) Foreign Application Priority Data

Jun. 14, 2006 (JP) ..... 2006-164472

(51) Int. Cl.
*G08B 1/08* (2006.01)

(52) U.S. Cl. ..... 340/539.24; 340/539.1; 340/539.14; 340/679

(58) Field of Classification Search ..... 340/539.1, 340/539.11, 539.14, 679, 691.6, 3.1, 825.36, 340/825.49; 219/490
See application file for complete search history.

(56) References Cited

U.S. PATENT DOCUMENTS 5,382,943 A * 1/1995 Tanaka ..... 340/539.22
5,543,778 A * 8/1996 Stouffer ..... 340/539.14
6,211,782 B1 * 4/2001 Sandelman et al. ..... 340/506
6,784,801 B2 * 8/2004 Watanabe et al. ..... 340/679
7,146,253 B2 * 12/2006 Hoog et al. ..... 700/276
2005/0253682 A1 11/2005 Kato et al.
2005/0255831 A1 11/2005 Kato et al.
2006/0091877 A1 * 5/2006 Robinson et al. ..... 324/76.11

FOREIGN PATENT DOCUMENTS

JP 09-280557 10/1997
JP 10-213348 8/1998
JP 2004-076969 3/2004
JP 2005-328295 11/2005

* cited by examiner

*Primary Examiner*—Daryl Pope
(74) *Attorney, Agent, or Firm*—Turocy & Watson, LLP

(57) ABSTRACT

A relay apparatus for relaying communication between a water heater main body and a radio remote control unit, comprising: a switch section for setting an address of the radio remote control unit; a control section for establishing communication with the water heater main body and commanding and controlling to read out maintenance information stored in the water heater main body assuming that input information at the switch section is a request from the radio remote control unit having an address which was set by operation of the switch section; and a display section for displaying the maintenance information received from the water heater main body.

6 Claims, 4 Drawing Sheets

《 MAINTENANCE INFORMATION DISPLAY FLOW 》

RELAY APPARATUS

BACKGROUND OF THE INVENTION

1. Field of the Invention

The present invention relates to a relay apparatus which relays communication between a water heater main body and a radio remote control unit, and more particularly, to a relay apparatus which establishes wire communication with the water heater main body and which establishes radio communication with the radio remote control unit.

2. Description of the Related Art

As a conventional water heater, since an indoor wiring operation of a remote control unit is unnecessary and installation is easy, and besides a remote control unit can easily be provided for an already installed water heater, there is a water heater in which a relay apparatus (master set) is connected to an outdoor water heater main body by a wire, and the water heater main body is remote-operated by radio communication of a radio remote control unit (slave set) through the relay apparatus from a room (e.g., Japanese Patent Application Laid-open No. 2005-328295).

A plurality of radio remote control units can be installed in a bathroom, a kitchen and the like, wherein a master set ID of the relay apparatus is registered in each radio remote control unit, and a slave set ID of each radio remote control unit is registered in the relay apparatus. With this configuration, radio communication between the radio remote control units and the relay apparatus is performed without causing interference with other devices.

The radio remote control unit is usually used for operating the water heater. In addition to this, the radio remote control unit can also display maintenance information of the water heater main body on a display section by specifying and operating a switch at the time of maintenance operation of the water heater main body (e.g., Japanese Patent Application Laid-open No. HEI09-280557). Such a radio remote control unit can freely be taken outside. Therefore, an operator of the maintenance operation takes the radio remote control unit outside, displays the maintenance information at an outside installation place of the water heater main body, and the operator can carry out a predetermined maintenance operation while seeing the maintenance information.

However, if none of the radio remote control units is registered in the relay apparatus, the maintenance information of the water heater main body is not displayed. In a case where the water heater main body is set outside of a house, the relay apparatus is connected to the water heater main body, but none of the radio remote control units is ID-registered, the maintenance information of the water heater main body cannot be seen for e.g. inspection on setting condition of the water heater main body.

Even if at least one of the radio remote control units is registered in the relay apparatus, the maintenance information of the water heater main body cannot be seen when no one stays in the house or the radio remote control unit is out of order or the battery is dead. If the operator cannot see the maintenance information of the water heater main body, he or she cannot carry out the maintenance operation of the water heater main body.

Thus, in preparation for such cases, another radio remote control unit can be separately prepared for maintenance operation. This radio remote control unit is ID-registered in the relay apparatus, and maintenance information of the water heater main body is obtained by operating this radio remote control unit. However, it is very troublesome to prepare another radio remote control unit only for the maintenance operation and to ID-register the radio remote control prepared for the maintenance operation. Further, it is necessary to delete the ID registration of the radio remote control in the relay apparatus after the maintenance operation is completed. Furthermore, where the operator doesn't know whether or not a radio remote control unit is used during the maintenance operation is carried out, it is uneconomical to separately prepare the radio remote control unit for the maintenance operation, which leads to an increase in the maintenance cost. Even when the radio remote control unit is separately prepared, if the full registrable number of radio remote control units are all registered in the relay apparatus, another radio remote control unit cannot be further ID-registered. Therefore, the operator cannot see the maintenance information in this case.

SUMMARY OF THE INVENTION

The present invention has been made in view of the above circumstances, and it is an object of the present invention to provide a relay apparatus capable of easily obtaining maintenance information from a water heater main body without using a radio remote control unit.

According to a first aspect of the invention, there is provided a relay apparatus for relaying communication between a water heater main body and a radio remote control unit, comprising:

a switch section for setting an address of the radio remote control unit;

a control section for establishing communication with the water heater main body and commanding and controlling to read out maintenance information stored in the water heater main body, assuming that input information at the switch section is a request from the radio remote control unit having an address which was set by operation of the switch section; and a display section for displaying the maintenance information received from the water heater main body.

Other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIGS. 2A and 2B are plan views showing outward appearance of the relay apparatus and a radio remote control unit according to the embodiment, wherein FIG. 2A shows the radio remote control unit and FIG. 2B shows the relay apparatus.

DETAILED DESCRIPTION OF THE PREFERRED EMBODIMENTS

Figure 1:
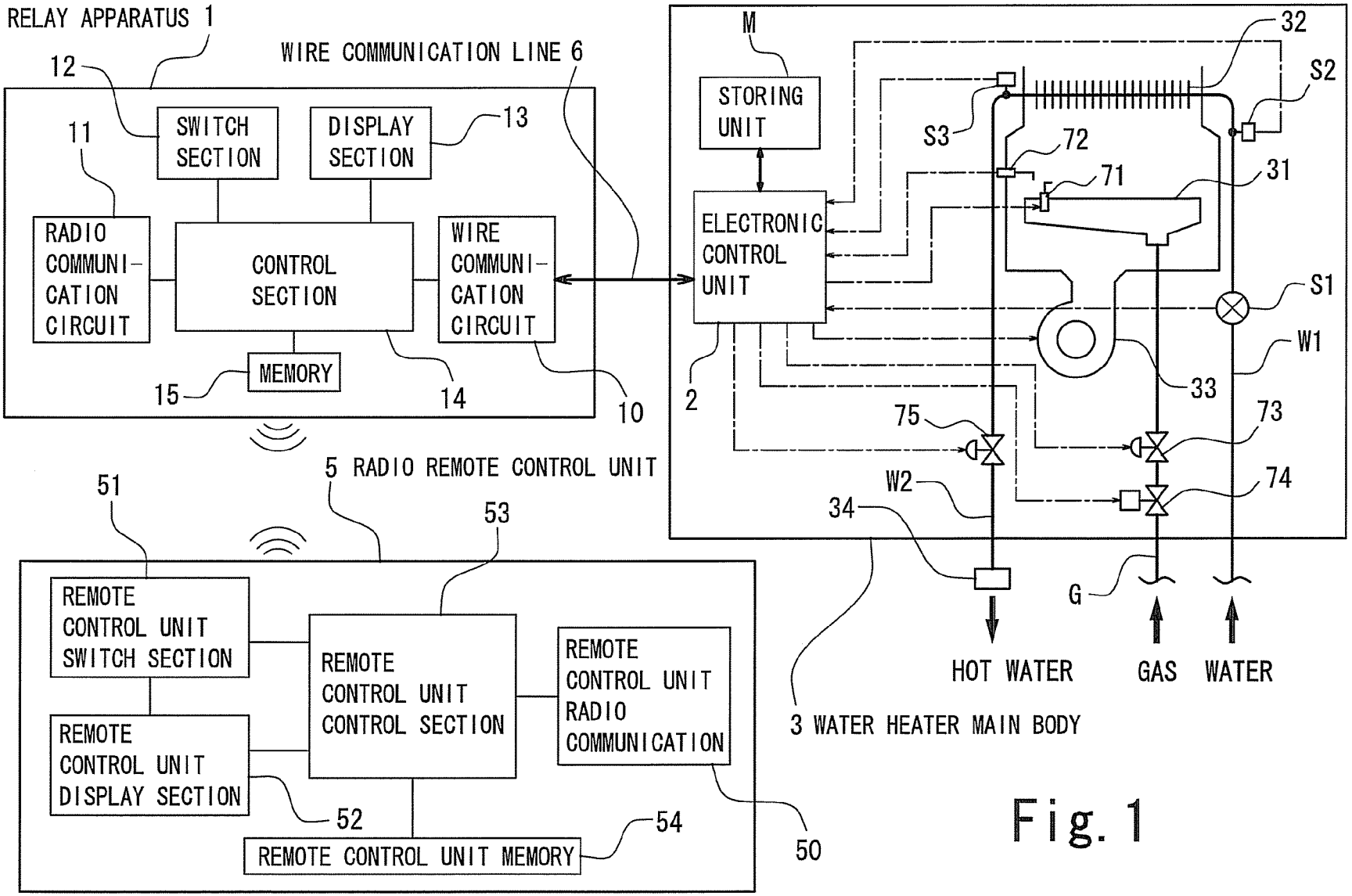
FIG. 1 is a block diagram showing a structure of a radio communication system including a relay apparatus according to an embodiment of the present invention.

As shown in FIG. 1, a relay apparatus 1 according to an embodiment of the present invention is used for a radio communication system in a water heater. The relay apparatus 1 performs wire communication with a water heater main body 3 outside the house and performs radio communication with radio remote control unit 5 in the house as well, and relays the radio communication of the radio remote control unit 5 which remotely operates the water heater main body 3.

The water heater main body 3 includes a burner 31, a heat exchanger 32, an air supply fan 33, an electronic control unit 2 and the like. The burner 31 is provided with an igniter 71 for ignition, and a flame rod 72 for detecting the ignition. The burner 31 has a gas supply passage G, and the gas supply passage G is provided with a gas amount adjusting valve 73 for adjusting the amount of gas to be supplied, and an interruption valve 74 for opening and closing the gas supply passage G. A water supply passage W1 for tap water is connected to an upstream side of the heat exchanger 32, and a hot water supply passage W2 is connected to a downstream side of the heat exchanger 32. The water supply passage W1 is provided with a water amount sensor S1 for detecting an outgoing hot water amount, and a hot water temperature sensor S2 for detecting hot water temperature. The hot water supply passage W2 is provided with an outgoing hot water temperature sensor S3 for detecting outgoing hot water temperature, and a flow rate adjusting valve 75 for adjusting an outgoing hot water amount. A faucet 34 for switching between the opening and closing of the valve is connected to a terminal end of the hot water supply passage W2.

The electronic control unit 2 which controls various operations of the water heater main body 3 is connected with the igniter 71, the flame rod 72, the gas amount adjusting valve 73, the interruption valve 74, the water amount sensor S1, the hot water temperature sensor S2, the outgoing hot water temperature sensor S3, the flow rate adjusting valve 75 and the air supply fan 33. A storing unit M is connected to the electronic control unit 2. Maintenance information including setting conditions of the water heater main body 3 and operational history are stored in the storing unit M. The storing unit M contains an EEPROM or the like, and the maintenance information is read and rewritten by control of the electronic control unit 2. Examples of the maintenance information are setting conditions such as model type, kinds of gas to be applied, hot water supply ability, set hot water supply temperature, set number of rotation of fan, and set flow rate, and combustion time, hot water temperature, outgoing hot water temperature, operational history such as trouble history. The electronic control unit 2 is provided with a communication circuit (not shown) and is connected to the relay apparatus 1 through a wire communication line 6, and delivers various information to and from the relay apparatus 1 through wire communication.

The radio remote control unit 5 includes a remote control unit radio communication circuit 50 which performs radio communication with the relay apparatus 1, a remote control unit switch section 51 which remotely operates the water heater main body 3, a remote control unit display section 52 which displays information such as operational information at the remote control unit switch section 51 and driving information of the water heater main body 3, a remote control unit control section 53 which controls various operations of the radio remote control unit 5, and a remote control unit memory 54 for storing a slave set ID of its own and a master set ID of the relay apparatus 1.

Figure 2A:
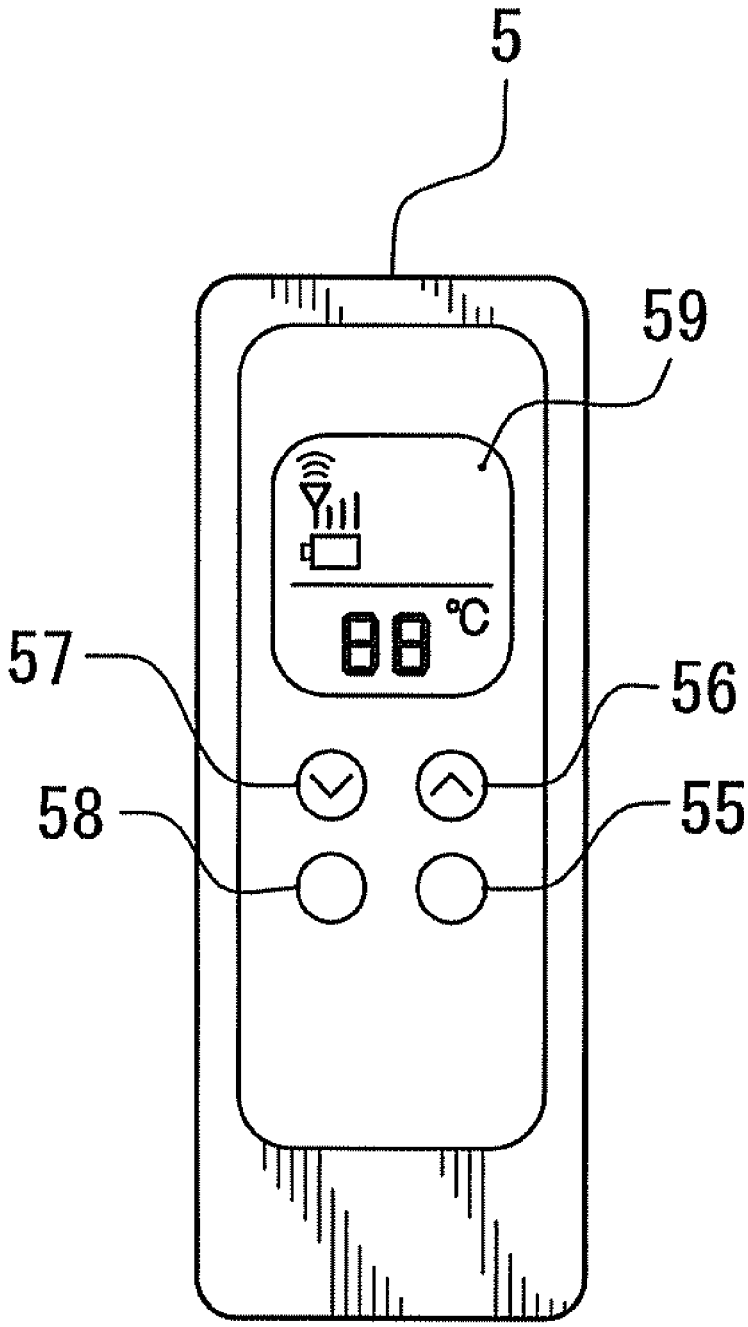

As an outward appearance structure of the radio remote control unit 5, as shown in FIG. 2A, the radio remote control unit 5 includes a driving switch 55 with respect to the water heater main body 3, an UP switch 56 and a DOWN switch 57 for setting the hot water supply temperature, a priority switch 58 which has precedence over other radio remote control units 5 for setting the hot water supply temperature, and a liquid crystal panel 59 for displaying the hot water supply temperature and the driving state of the water heater main body 3. The driving switch 55, the UP switch 56, the DOWN switch 57, the priority switch 58 and the like constitute the remote control unit switch section 51. The liquid crystal panel 59 constitutes the remote control unit display section 52. During the maintenance operation, the remote control unit switch section 51 of the radio remote control unit 5 functions as a special switch, and the maintenance information of the water heater main body 3 is displayed on the remote control unit display section 52.

The relay apparatus 1 can perform data communication with the maximum four radio remote control units 5. The relay apparatus 1 includes a wire communication circuit 10 which performs wire communication with the water heater main body 3, a radio communication circuit 11 which performs radio communication with the radio remote control unit 5, a switch section 12 for registering the radio remote control unit 5, a display section 13 for displaying the registration state of the radio remote control unit 5 and maintenance information, a control section 14 for controlling various operations of the relay apparatus 1, and a memory 15 for storing a master set ID of its own and a slave set ID of the radio remote control unit 5.

Figure 2B:
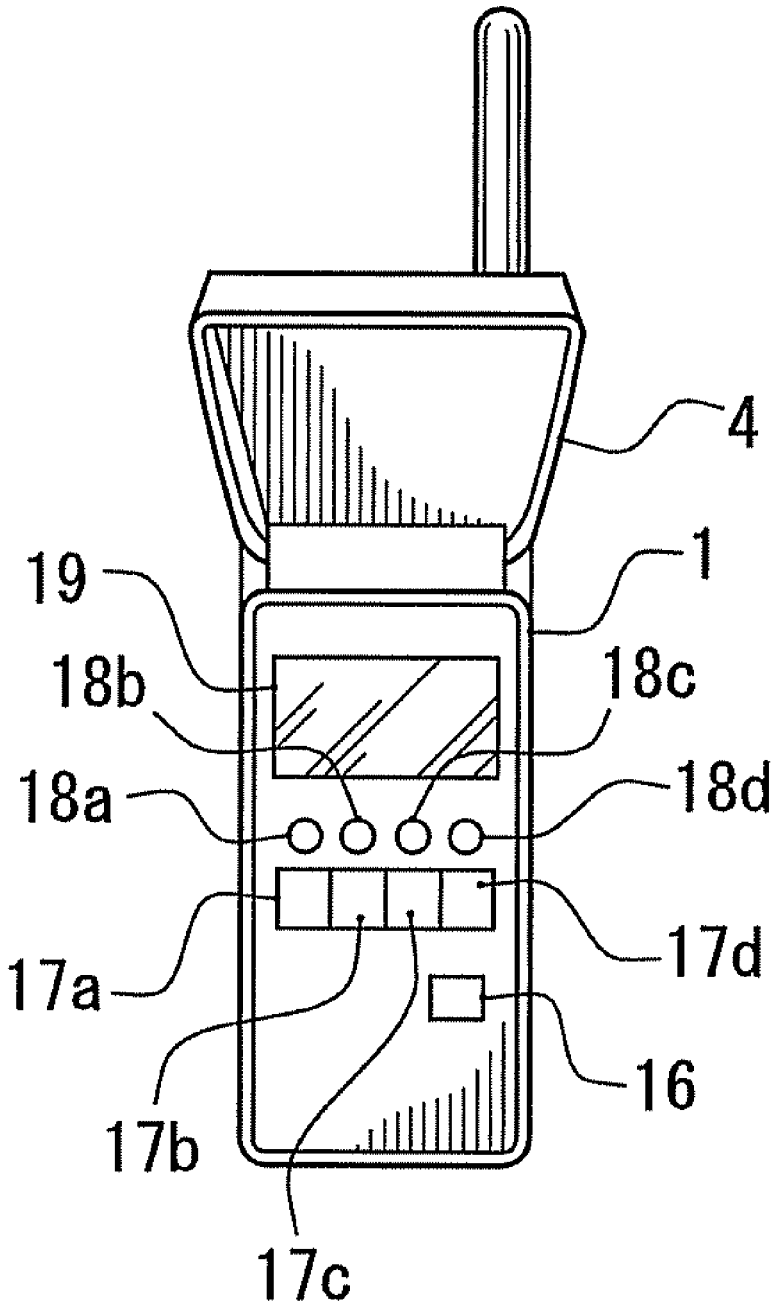

As an outward appearance structure of the relay apparatus 1, as shown in FIG. 2B, the relay apparatus 1 includes a lid 4 which is pivotally supported by an upper portion of the relay apparatus 1 for opening and closing a front surface of the relay apparatus 1, a registration switch 16 for registering the radio remote control units 5, registration clear switches 17*a* to 17*d* for deleting the registration of the radio remote control units 5 one by one, registration LEDs 18*a* to 18*d* for indicating a registration state of the radio remote control unit 5, and a display panel 19 for displaying the maintenance information. The registration switch 16 and the registration clear switches 17*a* to 17*d* constitute the switch section 12. The registration LEDs 18*a* to 18*d* and the display panel 19 constitute the display section 13.

In the relay apparatus 1 also, during the maintenance operation, the switch section 12 functions as a special switch, and the maintenance information of the water heater main body 3 is displayed on the display section 13 (display panel 19). For example, the registration clear switches 17*a* to 17*d* individually delete the registration of the slave set ID of each of the radio remote control units 5, but during the maintenance operation, the registration clear switches 17*a* to 17*d* also function as special switches for displaying the maintenance information of the water heater main body 3 on the display section 13 by performing specifying operation.

As pairing processing for mutually registering IDs between the relay apparatus 1 and the radio remote control unit 5, for example, an installation operator of the water heater main body 3 operates the registration switch 16 of the relay apparatus 1, operates the driving switch 55 of an unregistered radio remote control unit 5. With this, a master set ID and a slave set ID are transmitted and received between the relay apparatus 1 and the radio remote control unit 5. Then, the relay apparatus 1 and the radio remote control unit 5 recognize their mutual communication partners, the master set ID of the relay apparatus 1 is registered in the radio remote control unit 5, and the slave set ID of the radio remote control unit 5 as the communication partner is registered in the relay apparatus 1. Hence, the ID registration between the radio remote control unit 5 and the relay apparatus 1 is completed, and thereafter, radio communication can be established between them as the communication partners, and the radio remote control unit 5 can remotely operate the water heater main body 3 through the relay apparatus 1. Also, various information of the water heater main body 3 can be displayed on the radio remote control unit 5.

If the radio remote control unit 5 turns the driving switch 55 ON, a currently set hot water supply temperature or the like in the water heater main body 3 is displayed on the liquid crystal panel 59 by data communication including the slave set ID through the relay apparatus 1, and the set hot water supply temperature of the water heater main body 3 can be changed to a desired temperature by turning the priority switch 58 ON and by switching operation of the UP switch 56 and the DOWN switch 57. When the faucet 34 is opened, hot water at the hot water supply temperature, which has been set by the radio remote control unit 5, flows from the outgoing hot water opening by the operational control of the water heater main body 3.

Not only is the radio remote control unit 5 used for normal use of the hot water supply operation, but also the maintenance information of the water heater main body 3 is displayed on the liquid crystal panel 59 thereof by radio data communication including the slave set ID through the relay apparatus 1 during the maintenance operation. For example, in the ON state of the driving switch 55, if specifying operation in which the UP switch 56 and the DOWN switch 57 are pressed simultaneously is performed, an indication of the liquid crystal panel 59 (remote control unit display section 52) is switched to a maintenance mode, the maintenance information is transmitted from the water heater main body 3 to the radio remote control unit 5 by the radio data communication including the slave set ID through the relay apparatus 1, and the maintenance information is displayed on the liquid crystal panel 59. In this state, by appropriately operating the UP switch 56 and the DOWN switch 57, various maintenance information are successively displayed on the liquid crystal panel 59.

Next, a case in which the maintenance information is displayed by the relay apparatus 1 will be described.

The relay apparatus 1 relays communication between the radio remote control unit 5 and the water heater main body 3, and registers the radio remote control unit 5 and deletes the registration. The relay apparatus 1 also has a function to display the maintenance information of the water heater main body 3 like the radio remote control unit 5.

Figure 3:
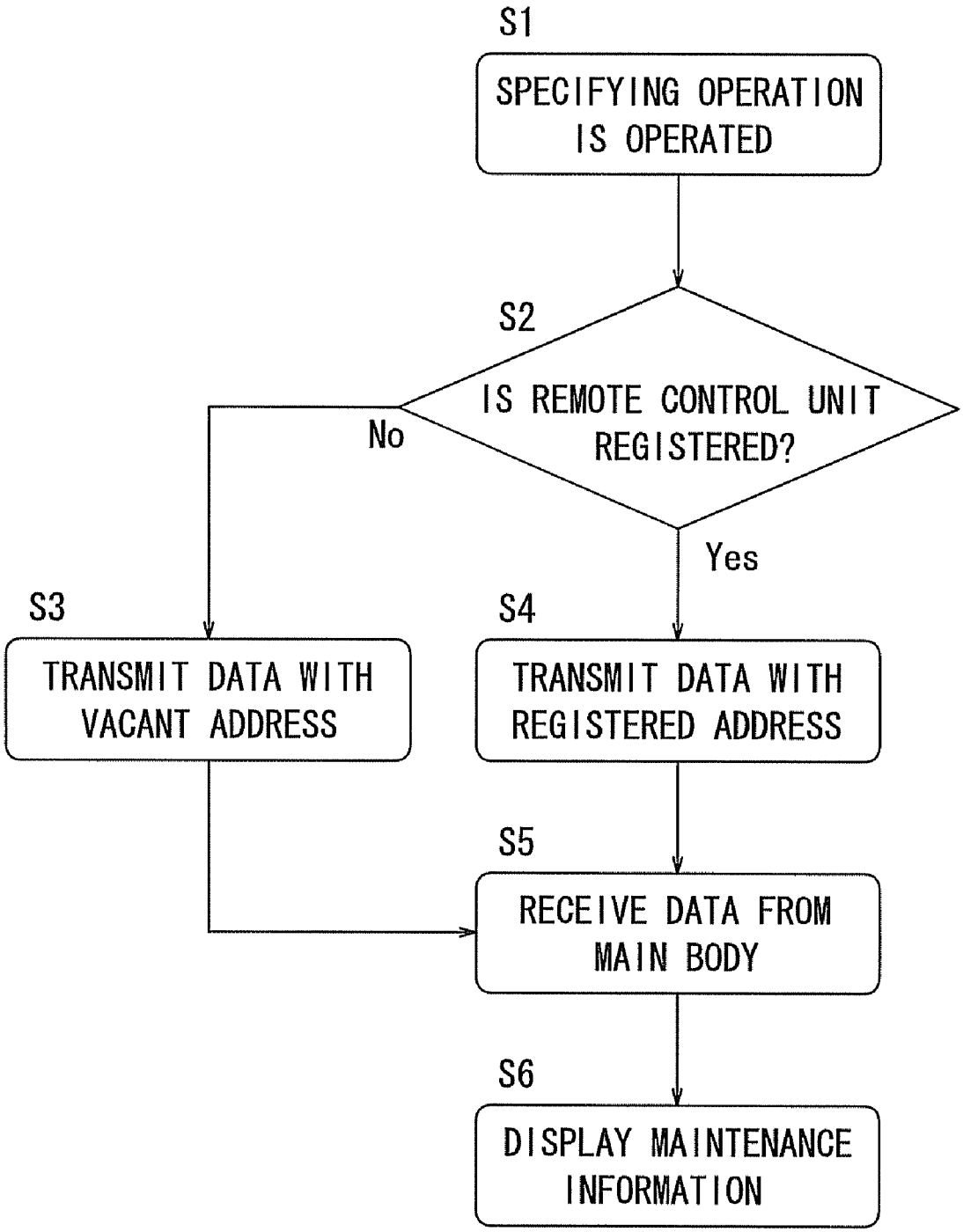
FIG. 3 is a flowchart showing operation procedure when maintenance information is displayed on the relay apparatus according to the embodiment.

As shown in FIG. 3, to display the maintenance information of the water heater main body 3 using the relay apparatus 1, a specifying operation of the relay apparatus 1 is first performed (S1) to switch the relay apparatus 1 from its normal mode to a maintenance display mode. For example, if the specifying operation in which any two of the registration clear switches 17*a* to 17*d* are pressed simultaneously is performed, the normal mode is switched to the maintenance display mode in the relay apparatus 1. Then, the registration clear switches 17*a* to 17*d* become the special switches (a selecting button 17*a*, a determining button 17*b*, an advancing button 17*c* and a returning button 17*d*) for displaying the maintenance information, and display of the display panel 19 is activated.

At the same time, registration information of the radio remote control unit 5 in the memory 15 is recognized, and if no radio remote control unit 5 is registered in the relay apparatus 1 (i.e. No in S2), the display panel 19 displays an input-waiting screen of a vacant address (slave set ID) of the radio remote control unit 5. The selecting button 17*a* is operated to select a vacant address of the radio remote control unit 5, the determining button 17*b* is operated for determination to input the vacant address of the radio remote control unit 5, i.e. an unregistered slave set ID to the relay apparatus 1. For example, the slave set ID is a five-digit code including numbers, alphabets and symbols, and inherent slave set ID is previously given to each radio remote control unit 5. In this case, however, since an actual radio remote control unit 5 does not exist, the operator can determine any slave set ID at will. A slave set ID to be inputted as a vacant address of the radio remote control unit 5 is effective only during the maintenance display mode, and the slave set ID serves as an authorization key for accessing the water heater main body 3.

Therefore, if the vacant address of the radio remote control unit 5 is inputted by the determining button 17*b*, the control section 14 of the relay apparatus 1 controls such that wire data for displaying the maintenance information is transmitted to the water heater main body 3 while recognizing the information inputted from the determining button 17*b* as a request from a virtual radio remote control unit 5 which is assumed by the vacant address (S3). Then, the water heater main body 3 which received this request reads the maintenance information from the storing unit M by the control of the electronic control unit 2, and transmits the maintenance information to the relay apparatus 1. When the relay apparatus 1 receives data of the maintenance information from the water heater main body 3 (S5), the relay apparatus 1 displays the maintenance information on the display panel 19 of the relay apparatus 1 (S6). At this time, in the relay apparatus 1, the advancing button 17*c* and the returning button 17*d* which now functions as the special switches are operated, the maintenance information is appropriately displayed on the display panel 19. The maintenance information displayed on the display panel 19 may also be provided as Japanese or English character information in addition to the numbers, symbols and codes.

As described above, when a radio remote control unit 5 is not registered in the relay apparatus 1, a vacant address of the radio remote control unit 5 (slave set ID of an unregistered radio remote control unit 5) is inputted to the relay apparatus 1 to have the radio remote control unit 5 assumed to be ID-registered in the relay apparatus 1. With this, the maintenance information of the water heater main body 3 is displayed on the display panel 19 of the relay apparatus 1 as a request from the virtual radio remote control unit 5. By this operation, even if individual information such as an address of a single radio remote control unit 5 has not been registered in the relay apparatus 1, the maintenance information of the water heater main body 3 can be displayed and seen in the relay apparatus 1. Thus, the operator can easily and swiftly see the maintenance information as compared with a case in which a separately prepared radio remote control unit 5 is ID-registered in the relay apparatus 1 to obtain the maintenance information of the water heater main body 3.

When at least one radio remote control unit 5 is registered in the relay apparatus 1 (i.e. Yes in S2), if the specifying operation for displaying the maintenance information is performed, the display panel 19 displays an input-waiting screen for registered address of the registered radio remote control unit 5. At this time, a slave set ID registered in the memory 15 may be displayed on the display panel 19 as a registered address. A registered address of the registered radio remote control unit 5 is selected by operating the selecting button 17*a*, and the registered address of a specific radio remote control unit 5, i.e., the registered slave set ID is inputted by operating the determining button 17*b*. The registered slave set ID of the radio remote control unit 5 to be inputted is effective only during the maintenance display mode, and the registered slave set ID serves as an authorization key for accessing the water heater main body 3.

When a registered address of a specific radio remote control unit 5 is inputted by the determining button 17*b*, the control section 14 of the relay apparatus 1 performs control such that wire data for displaying the maintenance information is transmitted to the water heater main body 3 while recognizing the information inputted from the determining button 17*b* as a request from the radio remote control unit 5 of the registered address (S4). The water heater main body 3 which receives this request reads maintenance information from the storing unit M by the control of the electronic control unit 2, and transmits the maintenance information to the relay apparatus 1. Then, when the relay apparatus 1 receives the maintenance information from the water heater main body 3, the relay apparatus 1 displays the maintenance information on the display panel 19 of the relay apparatus 1 (S6). At this time, in the relay apparatus 1, desired maintenance information is appropriately displayed on the display panel 19 by operating the advancing button 17*c* and the returning button 17*d* which now function as the special switches.

In this manner, even when the radio remote control unit 5 is registered in the relay apparatus 1, the registered address of the registered radio remote control unit 5 (slave set ID of the registered radio remote control unit 5) is inputted to the relay apparatus 1, and the maintenance information of the water heater main body 3 is displayed on the display panel 19 of the relay apparatus 1 as a request from the registered radio remote control unit 5. Hence, even when no one stays in the house or the radio remote control unit 5 is out of order or the battery is dead and thus the indoor radio remote control unit 5 cannot be used, maintenance information of the water heater main body 3 can be displayed in the relay apparatus 1 and can be seen. Thus, the operator can easily and swiftly see the maintenance information as compared with a case in which a separately prepared radio remote control unit 5 is ID-registered in the relay apparatus 1 to obtain the maintenance information of the water heater main body 3. Thus, the maintenance operation is not hindered.

According to the above embodiment, in the relay apparatus 1 which relays the communication between the radio remote control unit 5 and the water heater main body 3, maintenance information of the water heater main body 3 is displayed. With this configuration, when none of the radio remote control unit 5 has been registered in the relay apparatus 1 or when the indoor radio remote control unit 5 cannot be used for any reason, an operator of a maintenance operation can easily see the maintenance information in relay apparatus 1 without depending upon the radio remote control unit 5. Thus, the maintenance operation is not hindered.

Since the relay apparatus 1 is installed near the water heater main body 3, the operator can see the maintenance information of the water heater main body 3 near the water heater main body 3. Thus, the maintenance operation can be carried out efficiently.

Therefore, the operator can reliably see the maintenance information in the relay apparatus 1 irrespective of presence or absence of the radio remote control unit 5 and as a result, inspection of the setting conditions of the water heater main body 3 installed outdoor and inspection at the time of the maintenance operation of the water heater main body 3 can reliably and smoothly be carried out.

Other Embodiments

1) In the above embodiment, when no radio remote control unit 5 is ID-registered in the relay apparatus 1, a vacant address of an unregistered radio remote control unit 5 is inputted. Alternatively, the control section may be performed such that when at least one vacancy for an unregistered radio remote control unit exists in the relay apparatus 1, a vacant address of the unregistered radio remote control unit 5 is inputted to the relay apparatus 1 and maintenance information is displayed on the display panel 19 of the relay apparatus 1.

That is, the control section may be performed such that when radio remote control units 5 are ID-registered in the relay apparatus 1 but not all the registrable number of radio remote control units 5 are registered in the relay apparatus 1, maintenance information is displayed on the display panel 19 of the relay apparatus 1 by inputting a vacant address of an unregistered radio remote control unit 5 or by inputting a registered address of the registered radio remote control unit 5.

2) The control section may be performed such that only when at least one vacancy for an unregistered radio remote control unit 5 exists in the relay apparatus 1, a vacant address of the unregistered radio remote control unit 5 is inputted to the relay apparatus 1 and maintenance information is displayed on the display panel 19 of the relay apparatus 1.

3) The control section may be performed such that only when at least one radio remote control unit 5 is ID-registered in the relay apparatus 1, an address of the registered radio remote control unit 5 is inputted to the relay apparatus 1 and the maintenance information is displayed on the display panel 19 of the relay apparatus 1.

4) The registration clear switches 17*a* to 17*d* of the relay apparatus 1 function as special switches by a specifying operation for displaying the maintenance information, but the switches used exclusively for displaying the maintenance information may be provided on the relay apparatus 1.

5) The display panel 19 of the relay apparatus 1 displays maintenance information, but the display panel 19 may also display information such as operation information of the radio remote control unit 5 and operational information of the water heater main body 3 obtained by relay of communication between the radio remote control unit 5 and the water heater main body 3, and various information (e.g., maintenance manual information) obtained by connecting the relay apparatus 1 to an external line (e.g., telephone line or the Internet line).

6) The relay apparatus 1 may be constituted such that if the switch section 12 is operated for displaying the maintenance information (e.g., specifying operations of the registration clear switches 17*a* to 17*d*), a slave set ID to be an address of the radio remote control unit 5 is automatically set, and the relay apparatus 1 establishes data communication with the water heater main body 3.

In this case, as a slave set ID to be used, a slave set ID to be a vacant address of a virtual radio remote control unit 5 may always be set automatically, or a slave set ID may be set in order of desired priority. For example, the control section 14 may be constituted such that when a radio remote control unit 5 for kitchen and a radio remote control unit 5 for bath are registered in the relay apparatus 1, a slave set ID (address) of the radio remote control unit 5 for kitchen is automatically set by priority, and when no radio remote control unit 5 is registered in the relay apparatus 1, a slave set ID to be a vacant address of a virtual radio remote control unit 5 is automatically set. The vacant address of the virtual radio remote control unit 5 may be set at random in the control section 14 of the relay apparatus 1, or may previously be registered in the memory 15.

With this configuration, an operator need not bother inputting directly an address of the radio remote control unit 5, and maintenance information can easily and swiftly be displayed on the relay apparatus 1.

As described in detail above, according to a first aspect of the invention, there is provided a relay apparatus for relaying communication between a water heater main body and a radio remote control unit, comprising:

a switch section for setting an address of the radio remote control unit;

a control section for communicating with the water heater main body and commanding and controlling to read out maintenance information stored in the water heater main body, assuming that input information at the switch section is a request from the radio remote control unit having an address which was set by operation of the switch section; and a display section for displaying the maintenance information received from the water heater main body.

In the configuration above, the address of the radio remote control unit may be automatically set by operating the switch section, may be manually set by operating the switch section, or may be set by selecting an address of a registered radio remote control unit displayed by operating the switch section.

According to the above configuration, by using the address of the radio remote control unit, the relay apparatus which relays the communication between the radio remote control unit and the water heater main body acquires maintenance information stored in the water heater main body, and maintenance information of the water heater main body is displayed on the display of the relay apparatus. Therefore, an operator of a maintenance operation can easily see the maintenance information in relay apparatus 1 without depending upon the radio remote control unit. Thus, the maintenance operation is not hindered.

Since the relay apparatus is installed near the water heater main body, the operator can see the maintenance information of the water heater main body near the water heater main body. Thus, the maintenance operation can be carried out efficiently.

In the relay apparatus above, when the radio remote control unit is not registered in the relay apparatus, the address of the radio remote control unit which is set by operation of the switch section may be a vacant address of the radio remote control unit.

According to the above configuration, even if individual information of even a single radio remote control unit has not been registered in the relay apparatus, the maintenance information of the water heater main body can be displayed and seen in the relay apparatus. Thus, the operator can easily and swiftly see the maintenance information as compared with a case in which a separately prepared radio remote control unit is ID-registered in the relay apparatus to obtain the maintenance information of the water heater main body. Thus, the maintenance operation is not hindered.

In the relay apparatus above, when the radio remote control unit is registered in the relay apparatus, the address of the radio remote control unit which is set by operation of the switch section may be a registered address of the radio remote control unit.

According to the above configuration, even when no one stays in the house or the radio remote control unit is out of order or the battery is dead and thus the indoor radio remote control unit cannot be used, maintenance information of the water heater main body can be displayed in the relay apparatus and can be seen. Thus, the operator can easily and swiftly see the maintenance information as compared with a case in which a separately prepared radio remote control unit is ID-registered in the relay apparatus to obtain the maintenance information of the water heater main body. Thus, the maintenance operation is not hindered.

Therefore, according to the relay apparatus provided by the invention, the operator can reliably see the maintenance information in the relay apparatus irrespective of presence or absence of the radio remote control unit and as a result, inspection of the setting conditions of the water heater main body installed outdoor and inspection at the time of the maintenance operation of the water heater main body can reliably and smoothly be carried out.

The present application claims priority based on a Japanese Patent Application No. 2006-164472 filed on Jun. 14, 2006, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A relay apparatus for relaying communication between a water heater main body and a radio remote control unit, comprising:

a switch section for setting an address of the radio remote control unit;

a control section for communicating with the water heater main body and commanding and controlling to read out maintenance information stored in the water heater main body, in accordance with input information at the switch section being a request from the radio remote control unit having an address which was set by operation of the switch section;

a display section for displaying the maintenance information received from the water heater main body; and a memory for storing the address of the radio remote control unit.

2. The relay apparatus according to claim 1 wherein when individual information of the radio remote control unit is not registered in the relay apparatus, the address of the radio remote control unit which is set by operation of the switch section is a vacant address of the radio remote control unit.

3. The relay apparatus according to claim 1, wherein when individual information of the radio remote control unit is registered in the relay apparatus, the address of the radio remote control unit which is set by operation of the switch section is a registered address of the radio remote control unit.

4. The relay apparatus according to claim 1, wherein the switch section switches a normal mode for relaying communication between the radio remote control unit and the water heater main body and a maintenance display mode for displaying the maintenance information.

5. A relay apparatus for relaying communication between a water heater main body and a radio remote control unit, comprising:

a switch section for setting an address of the radio remote control unit and switching a normal mode for relaying communication between the radio remote control unit and the water heater main body and a maintenance display mode for displaying the maintenance information stored in the water heater main body;

a control section for communicating with the water heater main body and commanding and controlling to read out the maintenance information, in accordance with input information at the switch section being a request from the radio remote control unit having an address which was set by operation of the switch section;

a display section for displaying the maintenance information received from the water heater main body; and a memory for storing the address of the radio remote control unit.

6. A relay apparatus for relaying communication between a water heater main body and a radio remote control unit, comprising:

a switch section that sets an address of the radio remote control unit;

a control section that sends wire data to the water heater main body to request maintenance information of the water heater main body such that the request is from the radio remote control unit set in the switch section;

a display section that displays the maintenance information received from the water heater main body; and a memory that stores the address of the radio remote control unit.

* * * * *